US008763293B2

(12) United States Patent
Blazek

(10) Patent No.: US 8,763,293 B2
(45) Date of Patent: Jul. 1, 2014

(54) DEVICE FOR STRIPPING CARTRIDGES

(75) Inventor: Timothy V. Blazek, Guilford, CT (US)

(73) Assignee: O.F. Mossberg & Sons, Inc., North Haven, CT (US)

( * ) Notice: Subject to any disclaimer, the term of this patent is extended or adjusted under 35 U.S.C. 154(b) by 77 days.

(21) Appl. No.: 13/457,757

(22) Filed: Apr. 27, 2012

(65) Prior Publication Data

US 2013/0055611 A1 Mar. 7, 2013

Related U.S. Application Data

(60) Provisional application No. 61/517,885, filed on Apr. 27, 2011.

(51) Int. Cl.
*F41A 15/10* (2006.01)

(52) U.S. Cl.
CPC ..... *F41A 15/10* (2013.01)
USPC ..... 42/25

(58) Field of Classification Search
CPC ..... F41A 15/08; F41A 15/10; F41A 15/12; F41A 15/14; F41A 15/16
USPC ..... 42/25; 89/185
See application file for complete search history.

(56) References Cited

U.S. PATENT DOCUMENTS 1,343,444 A 6/1920 Formby
2,619,876 A 12/1952 Olson
2,950,653 A * 8/1960 Harvey ..... 89/185
4,022,105 A * 5/1977 White ..... 89/149
H211 H * 2/1987 Vanderbeck ..... 42/17
4,744,164 A 5/1988 Rieger
6,032,395 A 3/2000 Bentley et al.
6,898,888 B2 5/2005 Greenhut
7,533,598 B1 5/2009 Murphy

FOREIGN PATENT DOCUMENTS

DE 102007034675 1/2009

* cited by examiner

*Primary Examiner* — Stephen M Johnson
(74) *Attorney, Agent, or Firm* — Donald S. Holland, Esq.; Holland & Bonzagni, P.C.

(57) ABSTRACT

Applicant has disclosed a method and apparatus to enhance feeding cartridges into the receiver of a bolt-action repeating rifle, from a detachable magazine. In the preferred embodiment, Applicant's invention strips the cartridges from the magazines and feeds the cartridges into the chamber by a spring-activated hinged flap, pinned in a mating recess in a breech bolt head, adjacent a well opening and the inserted magazine. The flap is biased by a spring, which tends to lower the flap away from the breech bolt head, when the breech bolt is in a retracted position. As the breech bolt is pushed forward, the flap engages a rim of the next cartridge to be fed from the magazine and pushes the cartridge out of the magazine, over a feed ramp of the magazine, towards the rifle's chamber. The flap raises, against spring pressure, as it contacts a feed ramp of the receiver, allowing the breech bolt to enter the locking area of the receiver.

2 Claims, 3 Drawing Sheets

DEVICE FOR STRIPPING CARTRIDGES

RELATED APPLICATION

This application claims priority to U.S. Provisional Patent Application Ser. No. 61/517,885, filed Apr. 27, 2011. Applicant claims priority from that application. Applicant also incorporates by reference that application in its entirety.

FIELD OF INVENTION

This invention relates generally to bolt action rifles. More specifically, it relates to devices for stripping cartridges from detachable magazines into a bolt-action repeating rifle.

BACKGROUND OF INVENTION

Cartridges (also known as rounds) for firearms are elongated. A typical cartridge includes a shell casing, made of brass, which is filled with an explosive propellant. At its rear or closed end, the casing has a rim or flange containing a primer. Next to the rim is an extractor groove, an annular groove machined into the casing which provides a grip for the gun's extractor to pull the fired or unfired casing from the chamber of the firearm. The front and opposite end of the casing is open. A bullet, projectile, or head, usually of lead (optionally jacketed) is partially inserted into the open or front end of the case by crimping the casing onto the bullet.

Some rifles have internally fixed magazines for feeding cartridges into a chamber. For example, U.S. Pat. No. 2,619,876 to Olson discloses a "magazine rifle" with an internal magazine.

Other rifles, such as the AR-15 bolt-action rifle, use detachable magazines instead to feed cartridges. Detachable magazines usually are elongated containers, generally rectangular in cross-section, which are attached to the underside of the rifle (i.e., inside a well opening of the receiver). Such magazines are commonly made of aluminum alloys, plastic, steel, or a combination.

Detachable magazines are usually closed on the sides and open on an upwardly facing top. The open top has a rectangular opening and includes two round-retaining members, known as feed lips, which project into or partly close the opening. An internal spring urges a follower or lifter (i.e., a shaped piece of plastic or metal) toward the open side. The spring-loaded follower in turn urges the rounds as a group up against the lips. The lips act as a stop for the rounds so that they are not expelled from the magazine.

Rounds are stacked or oriented in the detachable magazine such that the longitudinal axes of the rounds are substantially parallel and perpendicular to the direction of travel of the spring and follower. Adjoining rounds are oriented side-by-side and in the same direction, i.e., the bullets of adjacent rounds are next to each other, as are the cases.

The rounds are usually stacked in the magazine, either in a single straight column or in a staggered (zigzag) column (also called double-stacked or high-capacity) fashion. The double-stacked magazines, being wider, have a higher round capacity compared to single-column magazines of the same overall length.

At the top of such magazines, the lips alternately retain the left and right top-most round, as the rounds are fed up and picked off. The top-most round is held in place by only one of the lips. Hereafter the term "magazine" will mean magazines where the lips alternately retain the top-most round.

Prior to use, a firearm magazine must be loaded, charged, or filled with rounds. When a magazine is being loaded, it is necessary to depress all previously loaded rounds to provide vacant space below the lips so an additional round can be inserted or loaded into this space. Each time another round is loaded the spring is further compressed, requiring more insertion force.

When a magazine is fully loaded, the spring is fully compressed and exerts maximum upward force against the follower and rounds towards the lips. Sometimes though a spring is weakened. That can hinder stripping the rounds.

Accordingly, it is a primary object of the present invention to provide a mechanical device to help strip a cartridge off a detachable magazine.

It is another object to provide a cartridge stripper, attached to the breech bolt head, which cooperates with existing magazines.

It is another object to provide a cartridge stripper, commensurate with the above-listed objects, which has few moving parts and is durable to use.

SUMMARY OF INVENTION

Applicant has disclosed a method and apparatus (nicknamed the "Cartridge Pusher") to enhance stripping cartridges from a detachable magazine and feeding them into the chamber of a bolt-action repeating rifle. In the preferred "apparatus" embodiment, the Cartridge Pusher comprises a spring-biased extension (i.e., a hinged flap) pivotally attached to a mating recess in the bottom of the breech bolt head, adjacent the well opening in which the magazine is inserted. When the rifle's breech bolt is pushed forward, the Cartridge Pusher engages the rim of the next cartridge to be fed into the chamber, pushing the cartridge out of the magazine, over the feed ramp, towards the chamber. The Cartridge Pusher raises, against spring pressure, as it contacts the receiver's feed ramp, allowing the breech bolt to enter the locking area of the receiver.

BRIEF DESCRIPTION OF DRAWINGS

The above and other objects and advantages of the present invention will become more readily apparent upon reading the following description and drawings in which.

DETAILED DESCRIPTION OF PREFERRED EMBODIMENT(S)

Figure 1:
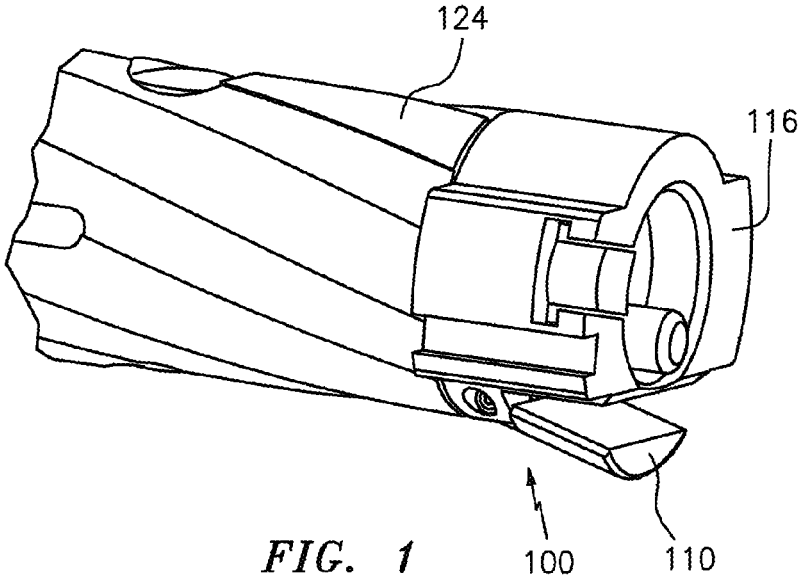
FIG. 1 depicts a preferred embodiment of Applicant's Cartridge Pusher pivotally attached to the bottom of a breech bolt head.
Figure 2:
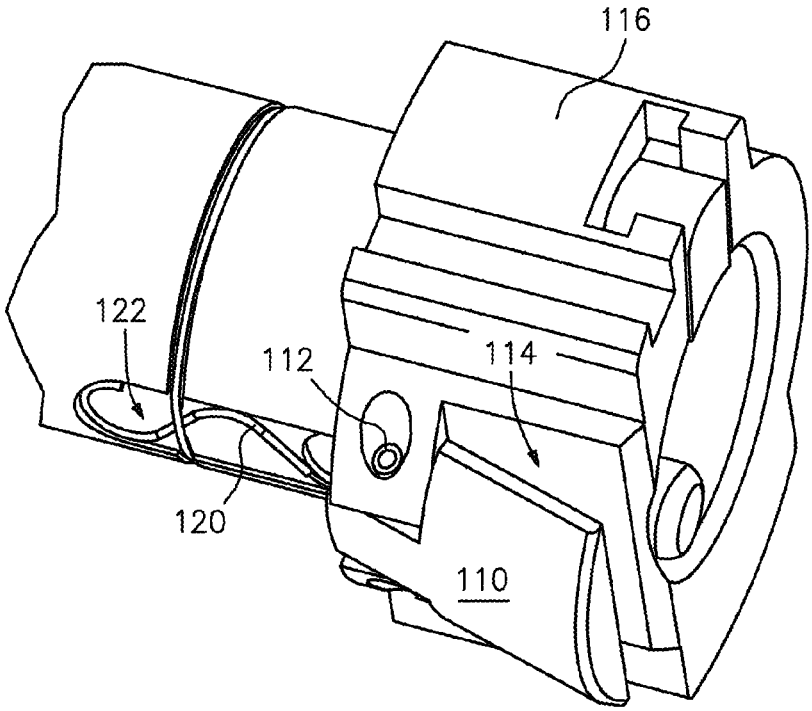
FIG. 2 is a close-up of FIG. 1 with portions removed.

Referring to the drawings in detail, Applicant has disclosed a mechanical device 100 to enhance stripping cartridges (e.g., 102) out of a detachable, double-stack magazine 104 and to enhance feeding the cartridges into the firing chamber 106 of a bolt-action repeating rifle 108. O.F. Mossberg & Sons, Inc. ("Mossberg") is the Assignee of this invention. Mossberg markets this device as the "Cartridge Pusher."

The Cartridge Pusher 100 comprises: a hinged extension or flap 110 pinned, by a cross pin 112, into a mating recess 114 (preferably machined) into the lower portion of the breech bolt head 116; wherein the flap 110 can pivot upon the cross pin 112; and wherein the flap is actuated or biased by a spring 120 contained in another recess 122 (preferably machined) into the bottom of breech bolt head 116.

Figure 3:
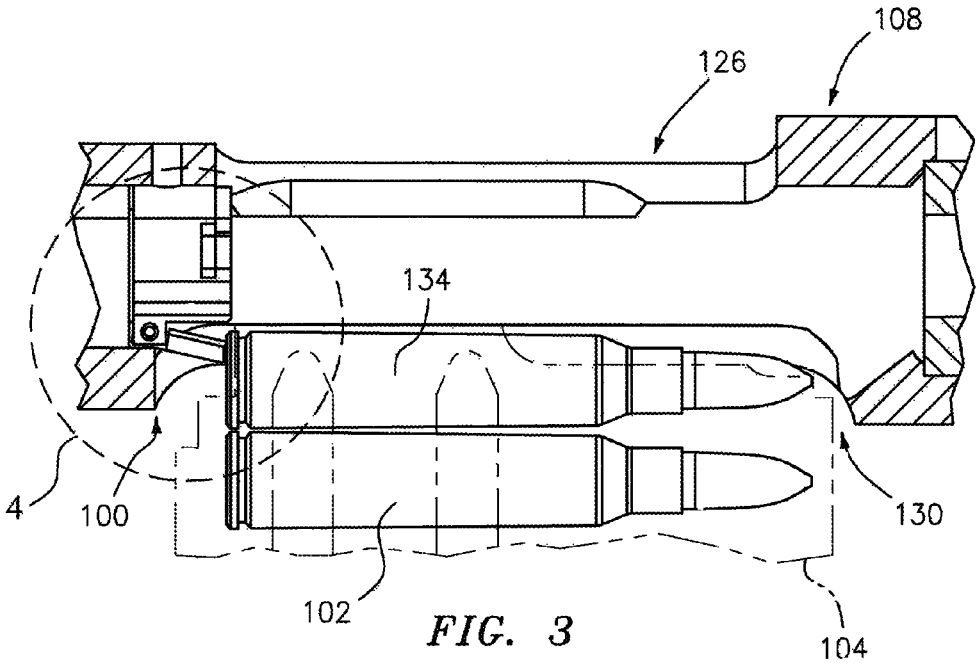
FIG. 3 depicts the Cartridge Pusher initially engaging the next cartridge in a magazine attached to the underside of a rifle.
Figure 4:
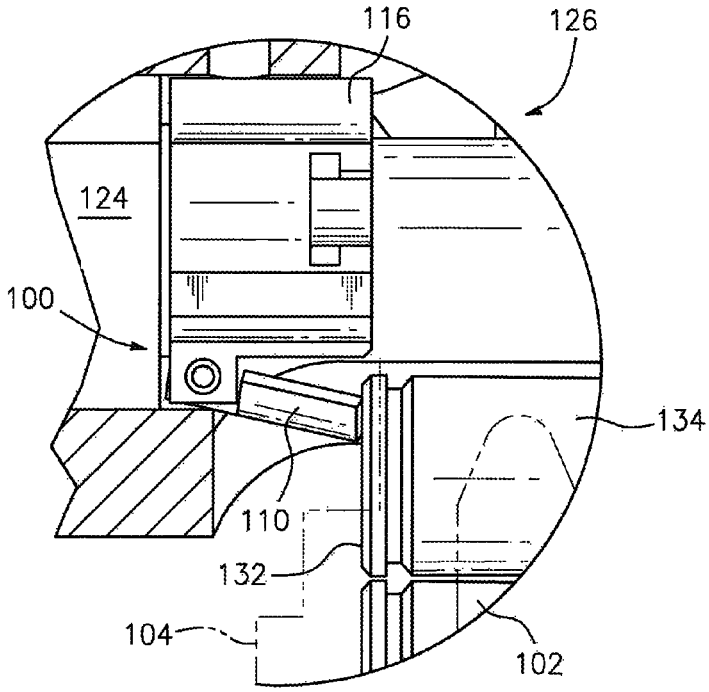
FIG. 4 is an enlarged view of an encircled portion of FIG. 3.
Figure 5:
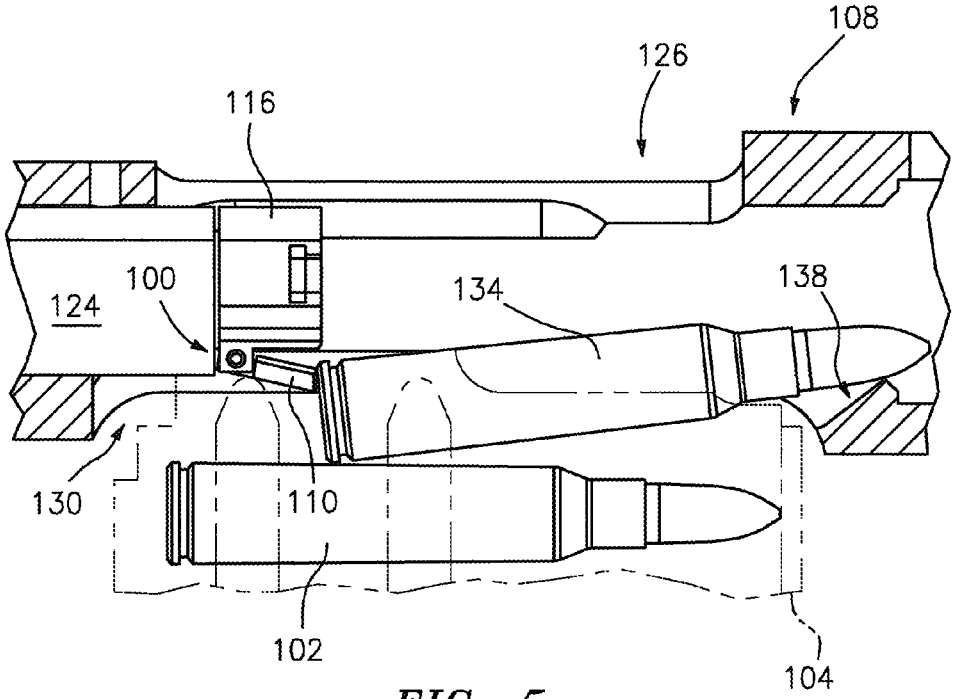
FIG. 5 depicts the Cartridge Pusher while a cartridge is being stripped from the magazine and fed into the rifle's receiver.
Figure 6:
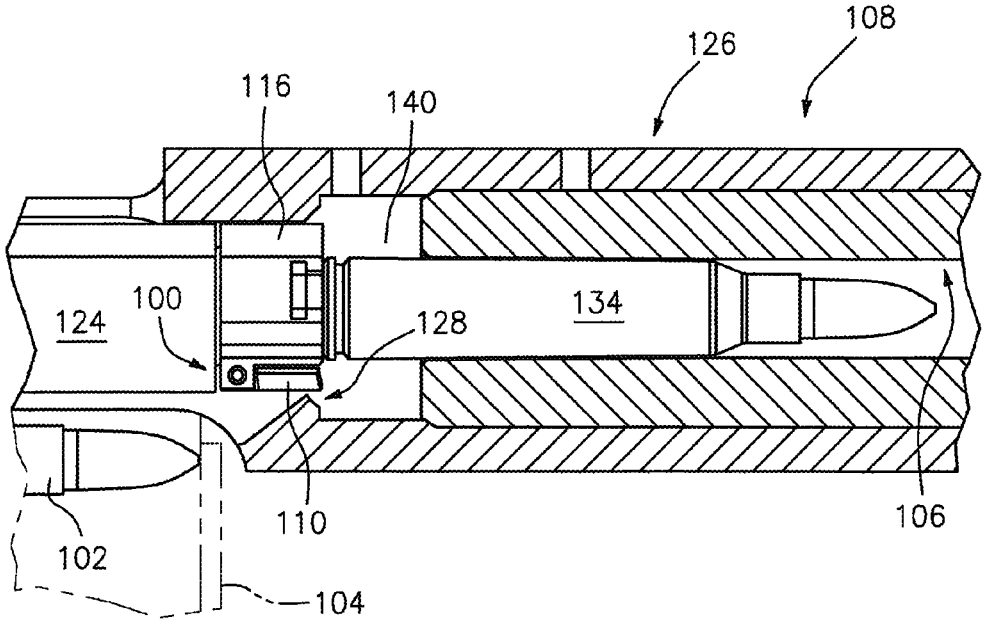
FIG. 6 depicts the position of the Cartridge Pusher after the cartridge has been stripped and fed into the receiver.

The flap 110 acts as an extension of the breech bolt head 116 down into the magazine 104 to provide reliable stripping and feeding of the cartridges contained in the magazine. Since the flap 110 is hinged and spring biased, the flap 110 can extend (i.e., pivot away from the breech bolt head 116—see FIGS. 3-5) or collapse (see FIG. 6) as needed to allow the breech bolt 124 to pass through the receiver 126.

As the breech bolt 124 is being pushed forward, the flap 110 is held in the raised (collapsed) position by a solid portion 128 of the receiver 126. Upon entering the magazine well opening 130 of the receiver 126, the flap 110 lowers under spring pressure. The flap 110 reaches its fully lowered position (see FIGS. 3-4) prior to engaging a rim 132 of the next cartridge 134 held in the magazine 104. As the breech bolt 124 continues being pushed forward, the flap 110 engages the rim 132 of the next cartridge 134 to be fed into the firing chamber 106, pushing the cartridge 134 out of the magazine 104 (see FIG. 5), over the receiver's feed ramp 138, towards the chamber 106. The Cartridge Pusher 100 raises, against spring pressure, as it contacts the feed ramp 138, allowing the breech bolt 124 to enter the locking area 140 of the receiver 126.

Applicant's invention, in a broad sense, can also be thought of as a method comprising:

a. inserting a detachable multi-stack magazine, with stored cartridges, into a magazine well opening of a receiver of a bolt-action repeating rifle;

b. removably attaching the inserted magazine to the receiver; and c. assisting stripping the cartridges from the magazine and assisting feeding the cartridges into a chamber of the rifle by a spring-biased hinged flap, pinned in a mating recess for the flap in a breech bolt head, adjacent the well opening and the inserted magazine.

It should be understood by those skilled in the art that obvious structural modifications can be made to the invention, without departing from the spirit of the invention. Accordingly, reference should be made primarily to the accompanying claims rather than the foregoing description to determine the scope of the invention.

Having thus described the invention, I claim:

1. A method comprising:

a. inserting a detachable multi-stack magazine, with held cartridges, into a magazine well opening of a receiver of a bolt-action repeating rifle;

b. removably attaching the inserted magazine to the receiver; and c. assisting stripping the cartridges from the magazine and assisting feeding the cartridges into a firing chamber of the bolt-action repeating rifle, via the following successive steps:

i. pushing a breech bolt head forward from a fully retracted position adjacent the well opening and the inserted magazine;

ii. lowering a distal end of a spring-biased hinged flap, pinned in a mating recess in a lower portion of the breech bolt head, by spring biasing the flap away from the recess as the breech bolt head moves forward from the fully retracted position;

iii. as the breech bolt head continues to move forward, engaging the distal end of the spring-biased flap with a rim of a next cartridge to be fed from the magazine into the firing chamber of the rifle, whereby the flap pushes the cartridge out of the magazine, over a feed ramp of the magazine, towards the firing chamber; and iv. as the breech bolt head moves further forward, raising the distal end of the flap, against spring pressure, into the mating recess in the breech bolt head as the distal end contacts a feed ramp of the receiver, allowing the breech bolt head to enter a locking area of the receiver.

2. In a bolt-action repeating rifle of the type having a receiver, a firing chamber, a manually moveable breech bolt, a breech bolt head attached to the breech bolt, and a magazine well opening in the receiver for receiving a detachable double-stack magazine, the improvement comprising:

a. the detachable double-stack magazine, loaded with cartridges, inserted into the well opening of the bolt-action repeating rifle and removably attached to the receiver; and b. an assistance mechanism for stripping the cartridges from the double-stack magazine and for feeding the cartridges into a firing chamber of the rifle, wherein the assistance mechanism comprises:

i. a spring-biased flap hinged in a mating recess, in a bottom of the breech bolt head, adjacent the well opening in which a magazine is inserted;

ii. a spring which tends to lower a distal end of the flap away from the mating recess in the breech bolt head, when the breech bolt head is in a retracted position;

iii. the distal end of the spring-biased flap, when the breech bolt head is pushed forward from the retracted position, lowers and then engages a rim of a next cartridge to be fed from the magazine into the firing chamber, pushing the cartridge out of the magazine, over a feed ramp of the magazine, towards the firing chamber; and iv. the distal end of the flap raises, against spring pressure, as the distal end of the flap contacts the feed ramp of the receiver, allowing the breech bolt to enter a locking area of the receiver.

* * * * *